US008074849B2

(12) United States Patent
Domoy et al.

(10) Patent No.: US 8,074,849 B2
(45) Date of Patent: Dec. 13, 2011

(54) TOGGLE ACTION DISPENSING CLOSURE WITH ARTICULATED REAR FLANGE

(75) Inventors: Brett Christopher Domoy, Brookfield, CT (US); Michael Lyons, Redding, CT (US)

(73) Assignee: Conopco, Inc., Englewood Cliffs, NJ (US)

( * ) Notice: Subject to any disclaimer, the term of this patent is extended or adjusted under 35 U.S.C. 154(b) by 350 days.

(21) Appl. No.: 12/432,085

(22) Filed: Apr. 29, 2009

(65) Prior Publication Data

US 2010/0276460 A1 Nov. 4, 2010

(51) Int. Cl.
*B65D 47/08* (2006.01)
*B65D 47/00* (2006.01)

(52) U.S. Cl. ..... 222/556; 222/536; 222/562

(58) Field of Classification Search ..... 222/402.1, 222/402.13, 536, 556, 562, 563
See application file for complete search history.

(56) References Cited

U.S. PATENT DOCUMENTS

| | | | | |
|---|---|---|---|---|
| 3,516,581 | A | 6/1970 | Micallef | |
| 4,776,501 | A | 10/1988 | Ostrowsky | |
| 4,962,869 | A | 10/1990 | Gross et al. | |
| 5,058,775 | A | 10/1991 | Gross et al. | |
| 5,065,912 | A * | 11/1991 | Rosenthal | 222/517 |
| 5,279,451 | A * | 1/1994 | Mueller et al. | 222/507 |
| 5,341,960 | A | 8/1994 | Lay | |
| 5,346,100 | A | 9/1994 | Lay | |
| 5,370,284 | A | 12/1994 | Dirksing | |
| 5,709,318 | A | 1/1998 | Oder | |
| 5,862,963 | A | 1/1999 | Fuchs et al. | |
| 5,873,494 | A | 2/1999 | Dallas, Jr. | |
| 5,918,777 | A | 7/1999 | Flak | |
| 6,029,866 | A | 2/2000 | Wood et al. | |
| 6,283,333 | B1 | 9/2001 | Knickerbocker et al. | |
| 6,343,725 | B1 | 2/2002 | Lohrman | |
| 6,564,978 | B1 | 5/2003 | Safian et al. | |
| 6,691,394 | B1 | 2/2004 | McClean | |
| 6,739,781 | B2 | 5/2004 | Maloney et al. | |
| 6,971,547 | B2 | 12/2005 | Englert et al. | |
| 2002/0125274 | A1 | 9/2002 | Beecroft | |
| 2002/0179644 | A1 | 12/2002 | Evans et al. | |
| 2004/0112927 | A1 | 6/2004 | Kaufman et al. | |
| 2004/0159684 | A1 | 8/2004 | Roberts et al. | |
| 2006/0186145 | A1 | 8/2006 | Rager | |
| 2007/0221689 | A1 | 9/2007 | Blum et al. | |
| 2007/0295739 | A1 | 12/2007 | Blum et al. | |

FOREIGN PATENT DOCUMENTS

EP 0 461 412 6/1990

(Continued)

OTHER PUBLICATIONS

*International Searth Report*, PCT/EP2010/055325, mailed Jul. 13, 2010, 3 pp.

*Primary Examiner* — Darren W Gorman
(74) *Attorney, Agent, or Firm* — Alan A. Bornstein

(57) ABSTRACT

A toggle-action dispensing closure is provided for manipulation between a closed, non-dispensing orientation and an open, dispensing orientation that is easily assembled, resists inadvertent opening and has an improved aesthetic appearance for variously shaped closures. The closure includes an actuator rotationally mounted on a housing whereby the housing may be secured to a container. The axis of rotation of the actuator is asymmetrically disposed in the housing. The actuator has a rear flange with an articulatable hinge that is longer than its front flange. When the closure is securely mounted to a container, the portion of the rear flange below the hinge resiliently contacts the container assisting in preventing inadvertently opening the closure.

7 Claims, 11 Drawing Sheets

FOREIGN PATENT DOCUMENTS

| | | |
|---|---|---|
| EP | 0 558 810 A1 | 9/1993 |
| GB | 2 434 574 | 8/2007 |
| WO | 94/29184 | 12/1994 |
| WO | 97/17261 | 5/1997 |
| WO | 99/36328 | 7/1999 |
| WO | 01/40095 | 6/2001 |

* cited by examiner

TOGGLE ACTION DISPENSING CLOSURE WITH ARTICULATED REAR FLANGE

BACKGROUND OF THE INVENTION

1. Field of the Invention

This invention relates to a toggle-action dispensing closure which can be manipulated between a closed orientation and an open, dispensing orientation.

2. The Related Art

Dispensing closures deliver consumer convenience and allow for product dispensing using simple mechanical action. Several versions of dispensing closures have been employed. See, for example, U.S. Pat. Nos. 5,341,950; 5,058,775; 4,952,869; 4,776,501; 4,545,086 and 3,516,581. One common version of the dispensing closure is commonly referenced as a "disk top" or "two piece pivot closure". Prior art closures that require a separate housing and actuator and that rely on a centralized, symmetrically disposed pivot point to function are disadvantageous because the closure requires a secondary assembly step after molding to marry the actuator and housing parts together making a closable cap. This requires precision alignment under tight clearances in order to properly assemble the two pieces. The pivot point of the movable actuator must have a centered fulcrum point to have equal movement in the housing to create an unbroken seal between the two pieces during actuation. The captive actuator is held in the housing only by the two pivot points. This makes the closure more sensitive to premature opening or dislodging during handling.

Surprisingly the problems of precision assembly and inadvertent opening were found to be solved by an actuator with an articulatable rear flange that is pivotally and asymmetrically mounted (off-centered) in the closure housing. The articulated actuator flange can be deflected inward to create a smaller foot print which eases the alignment of the actuator and housing during assembly improving quality, speed of assembly, expand design possibilities, be more tolerant of part variation due to tolerances and shrinkage, and potentially reduce part weight. This same feature also helps eliminate inadvertent opening due to housing deformation during shipment or due to rough handling. The articulatable hinge in the actuator was surprisingly seen to absorb energy transferred from housing deflection, thereby reducing the moment generated about the pivot point which prevents unintended opening. The force to actuate the articulation is less than what is required to open the closure.

Prior art toggle closures with a long actuator flange or "tail" require sufficient clearance under the location (or "button") that the user applies manual pressure to in order to open the toggle. The size and shape of the actuator will determine the amount of clearance required. The present invention allows for reduced or zero clearance beneath the button side of the actuator. Downward movement on the button of the actuator will articulate the rear flange of the actuator allowing the nozzle orifice to advance and open for dispensing.

A further unexpected improvement was seen with respect to the elimination of a rear gap created between the housing and actuator with specific shaped actuators when the toggle is opened. This improves aesthetics and eliminates negative issues created by such a gap (e.g. cleanliness and sharp edges).

SUMMARY OF THE INVENTION

In one aspect of the invention is a toggle-acting dispensing closure for use with an optional container, the closure includes but is not limited to:

a. a housing having a transverse floor and outer wall;

b. an actuator having a top wall including a top rear wall overlying the transverse floor and defining a nozzle opening with a floor, the actuator being asymmetrically and pivotally mounted inside the housing for movement between a closed, non-dispensing position and an open, dispensing position;

c. a rear actuator flange extending below the top rear wall at a first location and extending within the housing;

d. the rear flange having a hinge with a major axis that divides the rear flange into an upper rear flange adjacent to the top rear wall and a lower rear flange adjacent to a rear flange rim; and e. whereby the hinge major axis is oriented substantially parallel to the transverse floor.

BRIEF DESCRIPTION OF THE DRAWINGS

The foregoing features, advantages, and objects of this invention are now described in more detail with reference to the drawings in which like numerals are employed to designate like parts throughout the same.

DETAILED DESCRIPTION

For ease of description, the closure of this invention is described in an upright position, and terms such as upper, lower, horizontal, etc., are used with reference to this position. It will be understood, however, that the closure of this invention may be manufactured, stored, transported, used, and sold in an orientation other than the position described.

Figure 1:
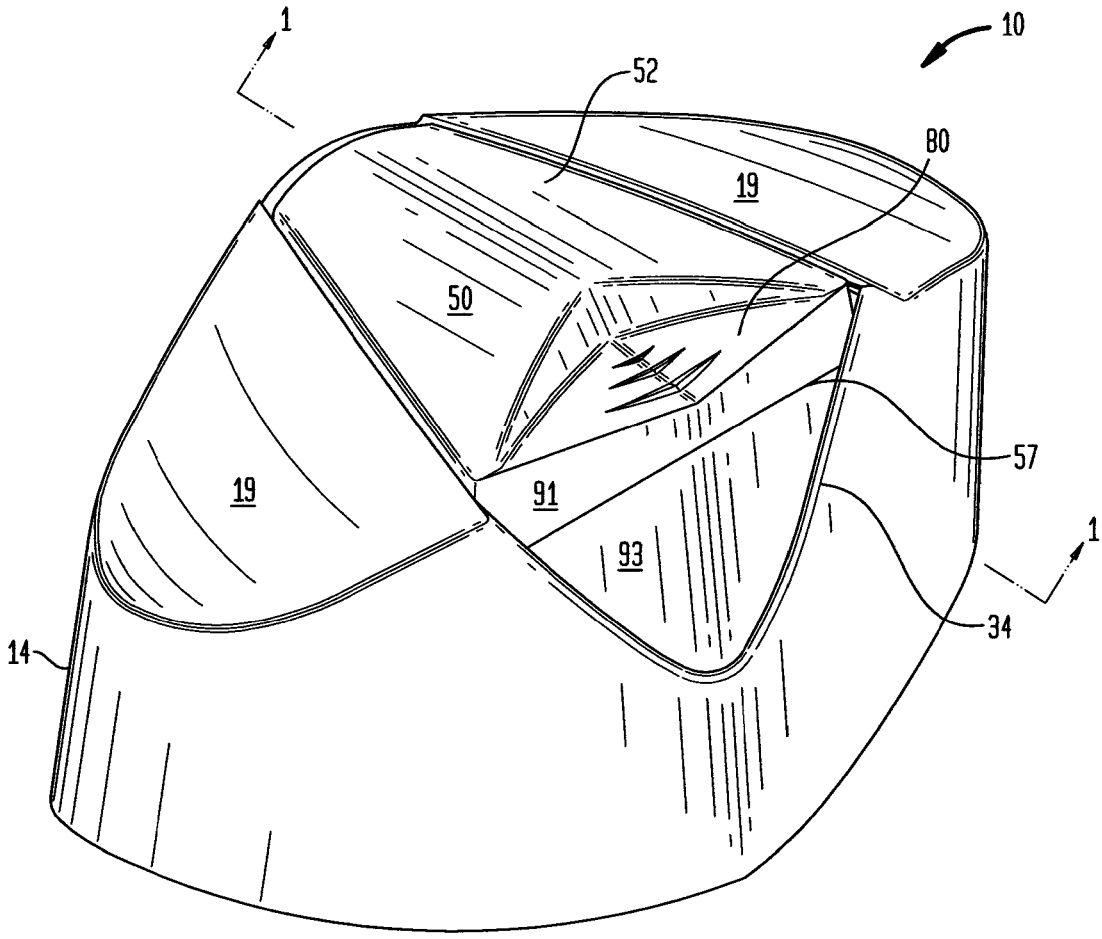
FIG. 1 is a perspective view of the closure of the present invention shown in a non-dispensing, closed orientation.

FIG. 1 shows a preferred embodiment of the dispensing closure 10 of the present invention in the closed, non-dispensing position. The closure 10 is adapted to be mounted on a container 200 (see FIGS. 8 and 9) which may have a conventional open mouth defined by a neck 210 (see FIGS. 8 and 9) or other suitable structure. The container most typically is of the type having a generally flexible wall portion which can be squeezed by a user to assist in dispensing the contents from the container but is not limited thereto.

The closure 10 includes a housing 14 (FIGS. 1-4, 8-11) for attachment to the container 200. The housing 14 includes a generally ovoid cylindrical, outer wall 16. A generally transverse closure wall or floor 18 having upper surface 180

(FIGS. 3, 4, 8-11) extends across actuator receptacle 15 molded into the housing 14. Actuator receptacle 15 is further defined by diametrically opposed receptacle walls 11 and front wall 13. Diametrically opposed roof segments 19 and shipping posts 87 flank aperture receptacle 15. In a second preferred embodiment receptacle 15 and floor 18 extend to the periphery of the housing defined by outer wall 16 where walls 11 are coincident with portions of outer wall 16 (not shown). Actuator 50 replaces roof segments 19 in this second embodiment.

Inner cylindrical wall 21 of housing 14 is adapted by way of snap-fit bead 190 to engage the outer periphery of the top of the container neck 210 around the container mouth 220, as with complementary container snap-fit bead 230 (FIGS. 4 and 8-11). Other suitable engaging means (e.g. threads or any suitable equivalent) may be provided to secure the housing 14 on the container 200. Alternatively, in some applications the housing 14 could be non-releasably attached to, or formed unitary with, the container 200.

An annular sealing ring 20 may be provided as shown in FIGS. 4 and 8-11 for engaging an interior edge of the container neck 210 at the container mouth to effect a tight seal.

The housing 14 includes a discharge aperture or passage 30 through the floor 18 as illustrated in FIGS. 3, 4, and 8 to 10. In a preferred embodiment, housing 14 includes a discharge tube 32 projecting upwardly from the floor 18, and the discharge aperture 30 fluidly communicates with tube 32. The discharge aperture 30 in the tube 32 communicates through the floor 18 with the optional container 200 interior at the lower end of the tube 32.

As shown in FIGS. 3, 4, and 8-11, the ovoid cylindrical, outer wall 16 of housing 14 extends around the floor 18. A rear portion of the wall 16 adjacent to floor 18 partially defines a finger recess area 34 in the form of a cutout or notch in the top edge of the rear portion of wall 16 opposite wall 13.

Figure 6:
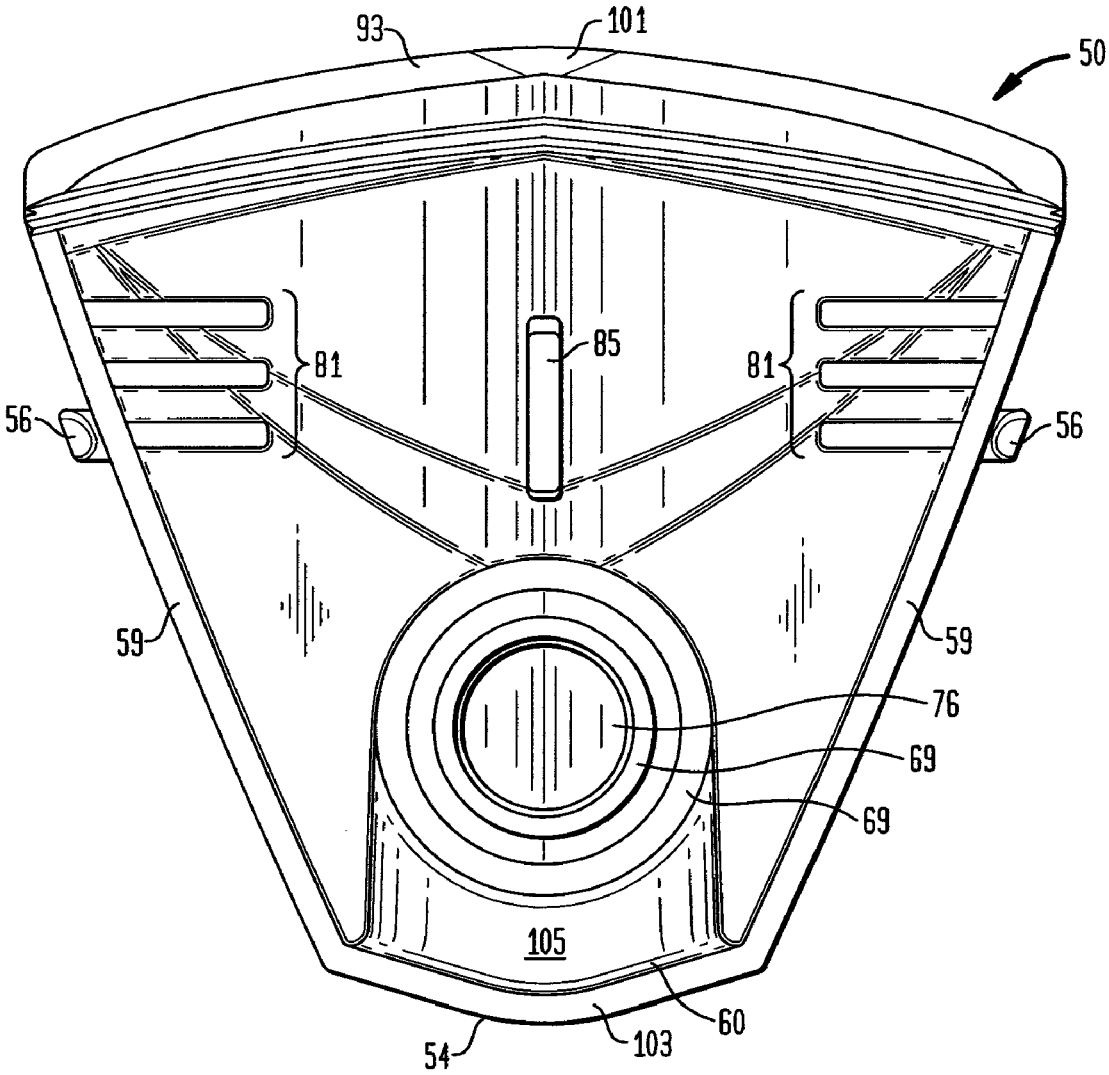
FIG. 6 is a bottom plan view of the actuator taken generally along the plane 5-5 in FIG. 5.
Figure 7:
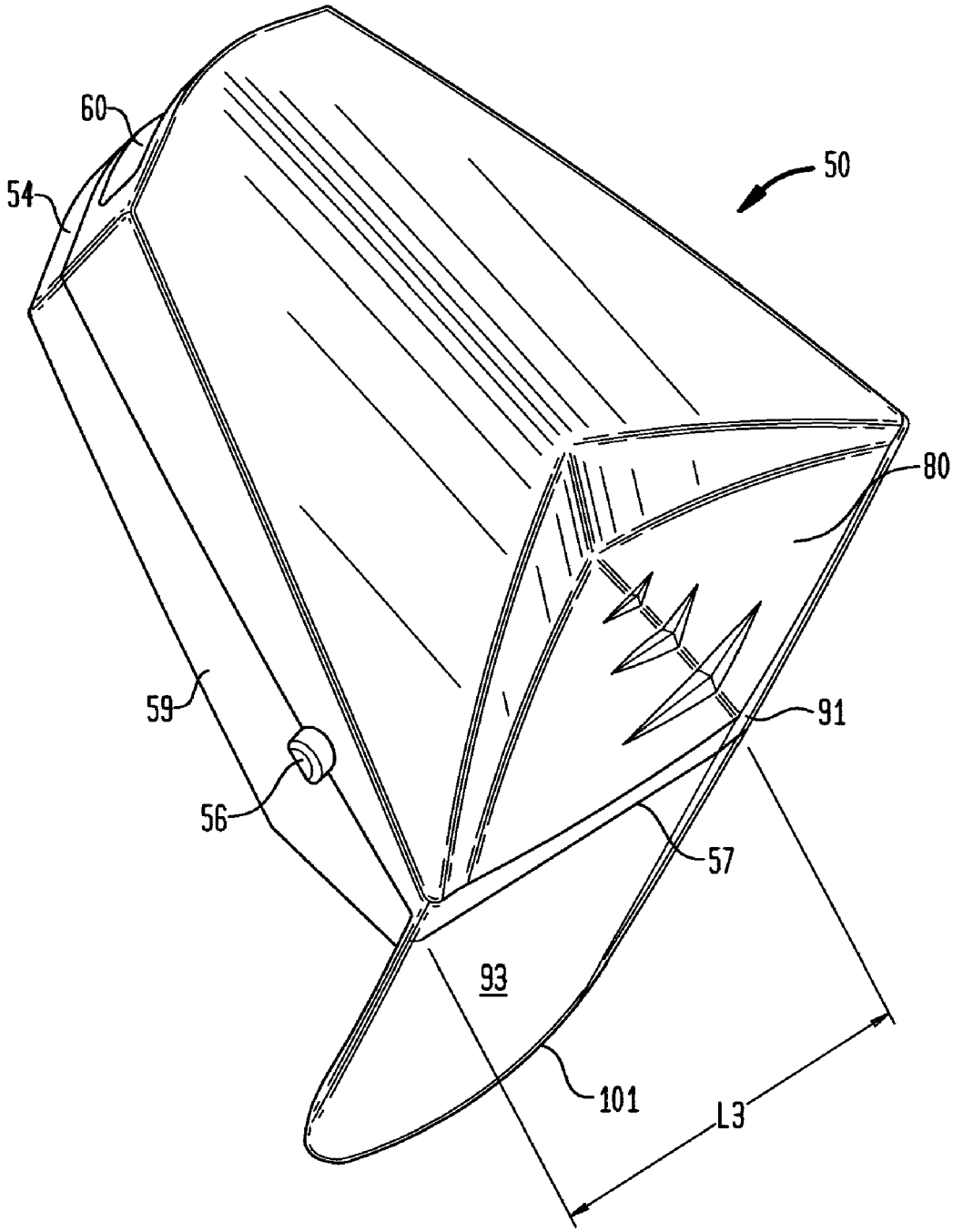
FIG. 7 is a perspective view of the actuator depicted in FIGS. 1, 2, 5 and 6.

The housing 14 receives actuator 50. The actuator 50 includes a transverse top wall 52 having a top rear wall 80, a front peripheral flange 54 and diametrically opposed side flanges 59. Adjacent to top rear wall 80 is a rear flange 55 having an articulatable hinge 57 dividing rear flange 55 into an upper rear flange 91 and a lower rear flange 93 with lower rim 101 (FIGS. 1, 2, 5-9 and 11). At each of two opposed side flanges 59 there is a projecting, hemispherical protuberance or pivot member 56, preferably with a flattened face (FIGS. 6 and 7).

In a preferred embodiment the pivot members 56 cooperate with the receptacle walls 11 by way of recesses 58 to asymmetrically mount the actuator 50 for pivoting movement within the housing 14. To this end receptacle walls 11 each define recess 58 (FIG. 3) for each mating with one of the pivot members 56 to provide a snap-action engagement of the pivot member 56. This accommodates the pivoting movement of the actuator 50 about a pivot axis defined by a line joining the pivot members 56 wherein the pivot axis is parallel to transverse floor 18 and asymmetrically positioned within housing 14.

Figure 2:
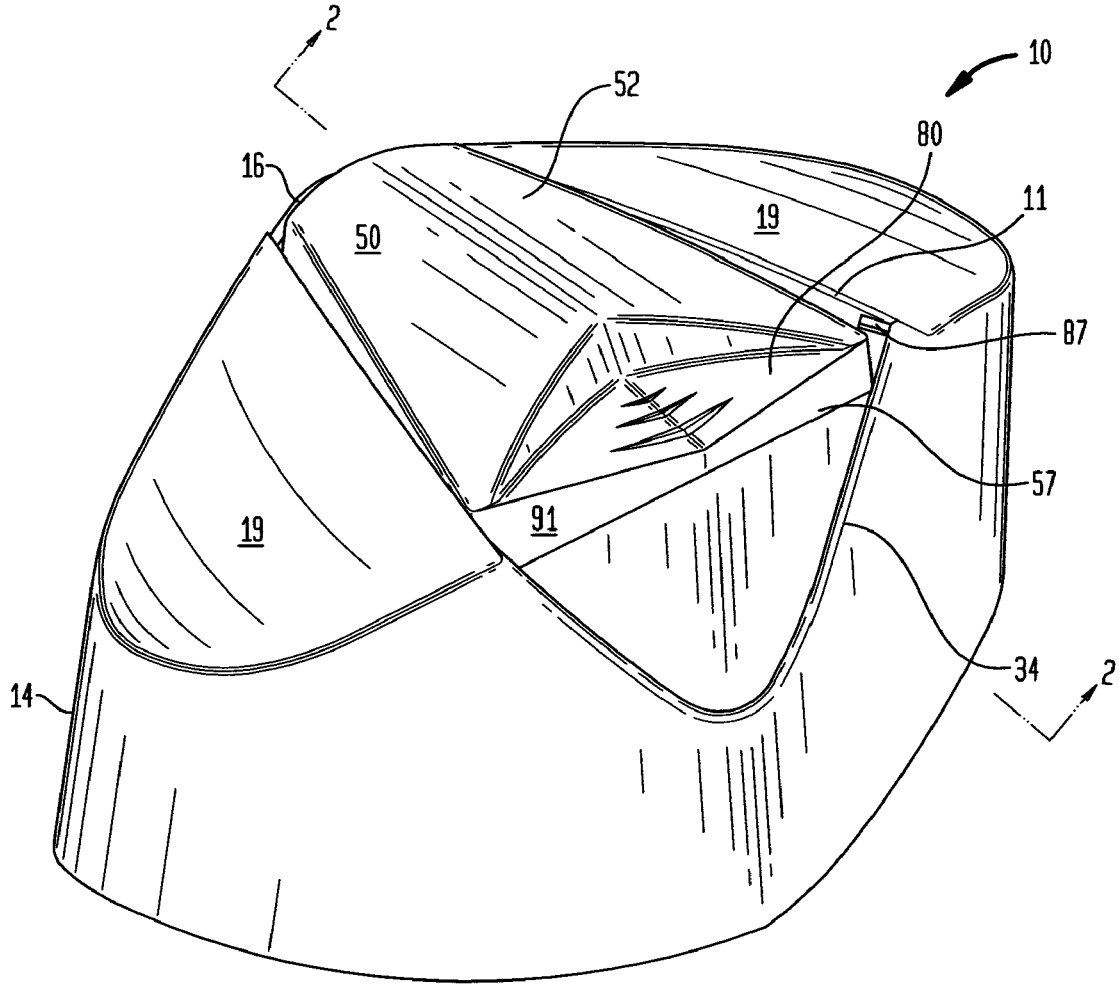
FIG. 2 is a perspective view of the closure shown in an open, dispensing orientation.

The top edge of the wall 11, above each recess 58, may be provided with a chamfer (not shown) for facilitating assembly. When the housing 14 and actuator 50 are assembled, the actuator pivot members 56 and housing recesses 58 function as part of the mounting structure so that the actuator 50 can be pivoted (by a user pushing downwardly on the rear portion of the actuator 50) until the nozzle 60 is exposed above the walls 11 and 13 as illustrated in FIG. 2. In the second preferred embodiment referred to above where the aperture recesses extend to housing outer wall 16, the pivot members 56 cooperate with wall 16 by way of complementary recesses defined by wall 16 where receptacle 15 and wall 11 extend to the periphery of the housing 14 coincident with wall 16.

The actuator 50 includes a conduit structure 61 communicating with nozzle 60, with a floor 105 connected to the bottom surface of the top wall 52. The actuator functions, depending upon its orientation, to either permit dispensing of flowable material from the discharge tube 32 and nozzle 60 or occlude tube 32 so as to prevent flow out of nozzle 60. In particular, as shown in FIGS. 5, 6, 8 and 9, conduit structure 61 fluidly communicates with stepped, cylindrical sealing walls 69.

Figure 8:
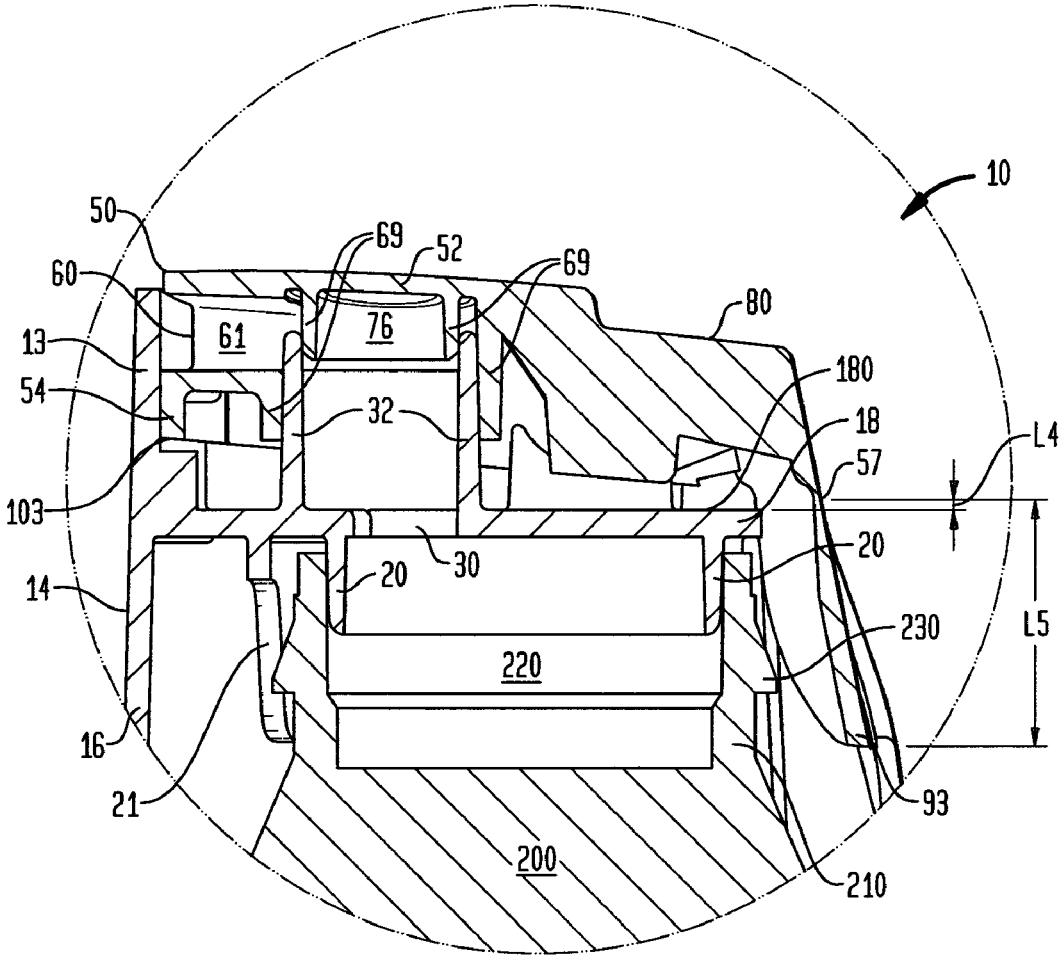
FIG. 8 is an enlarged, cross-sectional view taken generally along the plane 1-1 in FIG. 1 showing the closure attached to a bottle.

The walls 69 surround and seal the upper periphery of the discharge tube 32 when the actuator 50 is in the closed position as illustrated in FIGS. 1 and 8. Preferably, a sealing plug 76 projects downwardly from the bottom of the actuator top wall 52. The sealing plug 76 has a generally cylindrical or annular configuration and is adapted to sealingly engage the opening at the top of the discharge tube 32 to occlude the discharge aperture 30 and tube 32 when the actuator is in the closed position as illustrated in FIGS. 1 and 8. Tube 32 and walls 69 cooperate to provide sliding resistance to help prevent premature opening of the closure.

Figure 9:
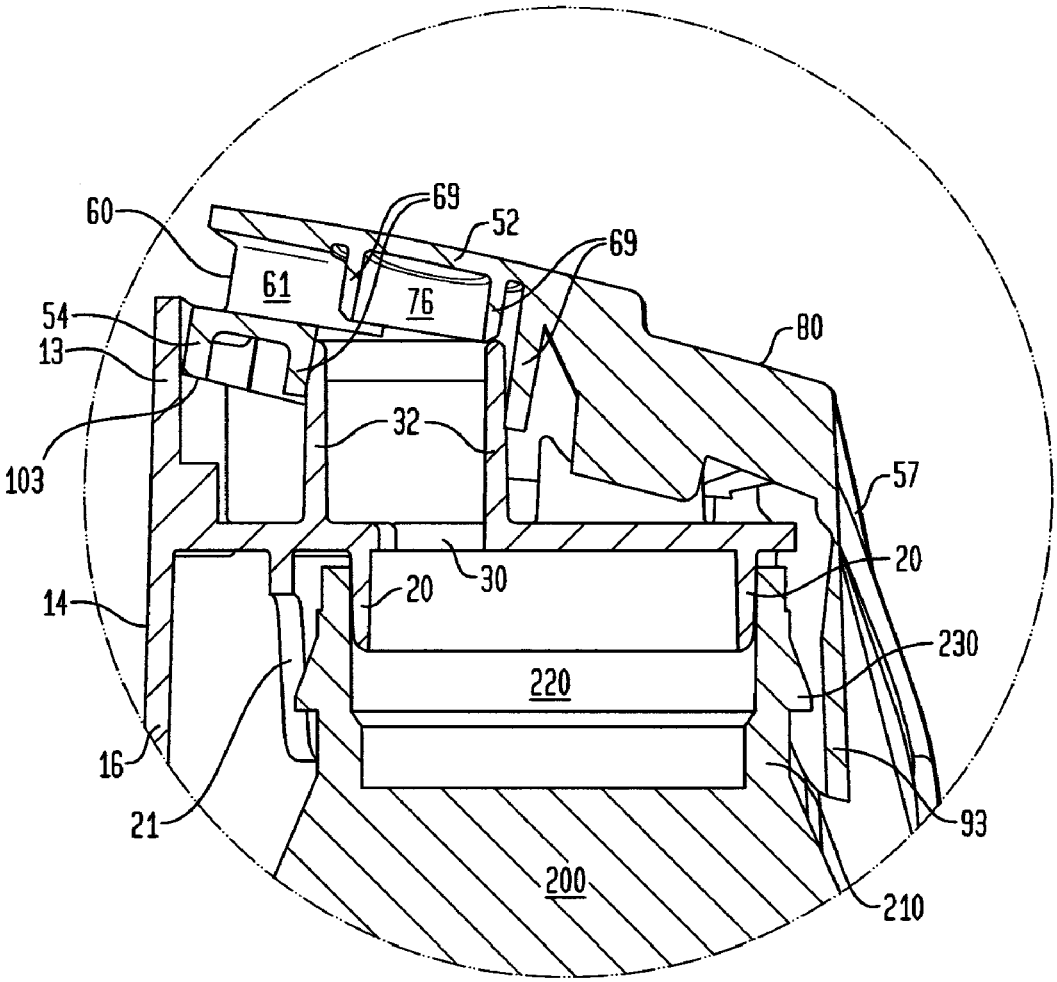
FIG. 9 is an enlarged, cross-sectional view taken generally along the plane 2-2 in FIG. 2 showing the closure attached to a bottle.
Figure 10:
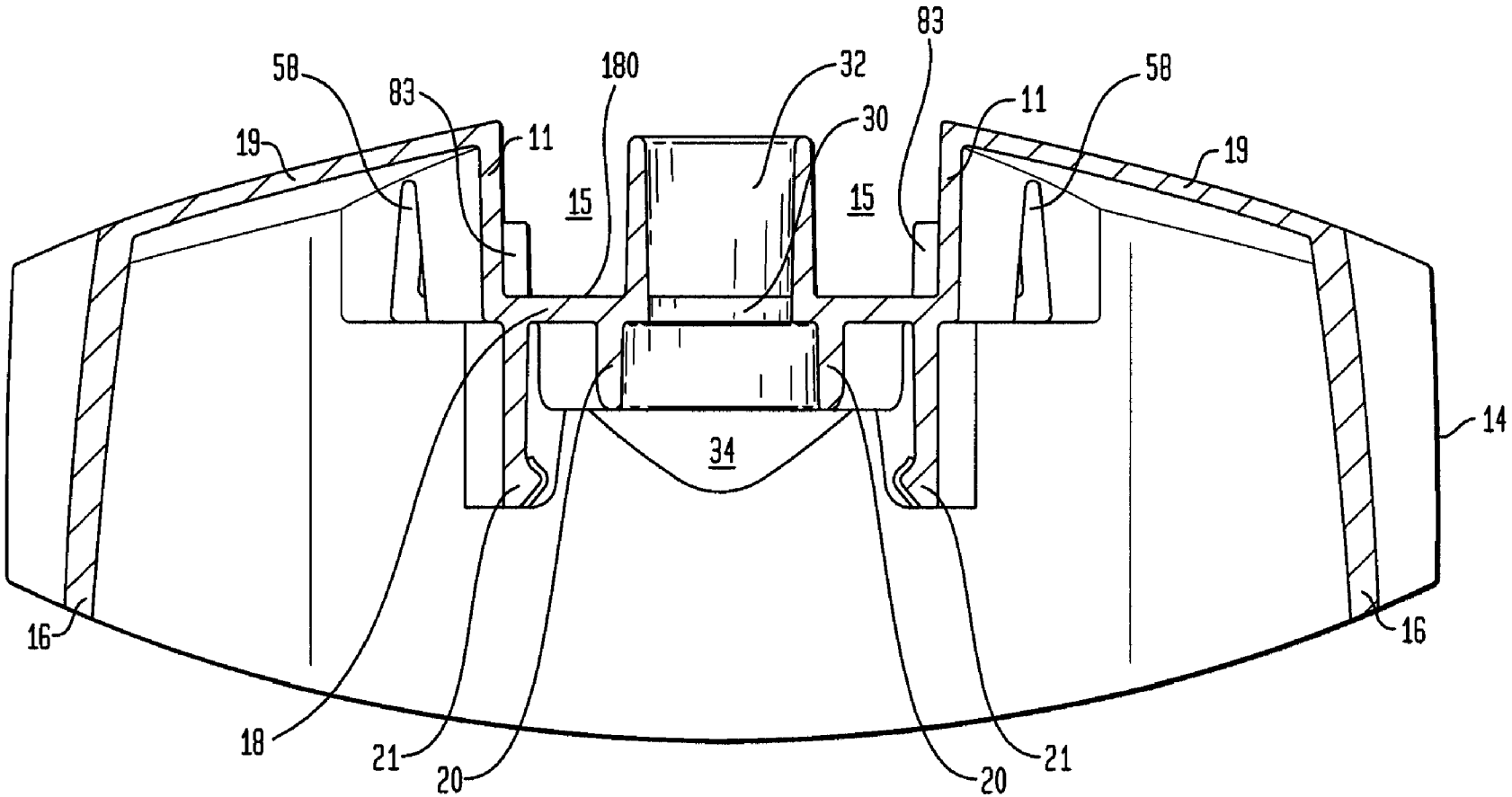
FIG. 10 is a cross-sectional view taken generally along the plane 4-4 in FIG. 3.
Figure 11:
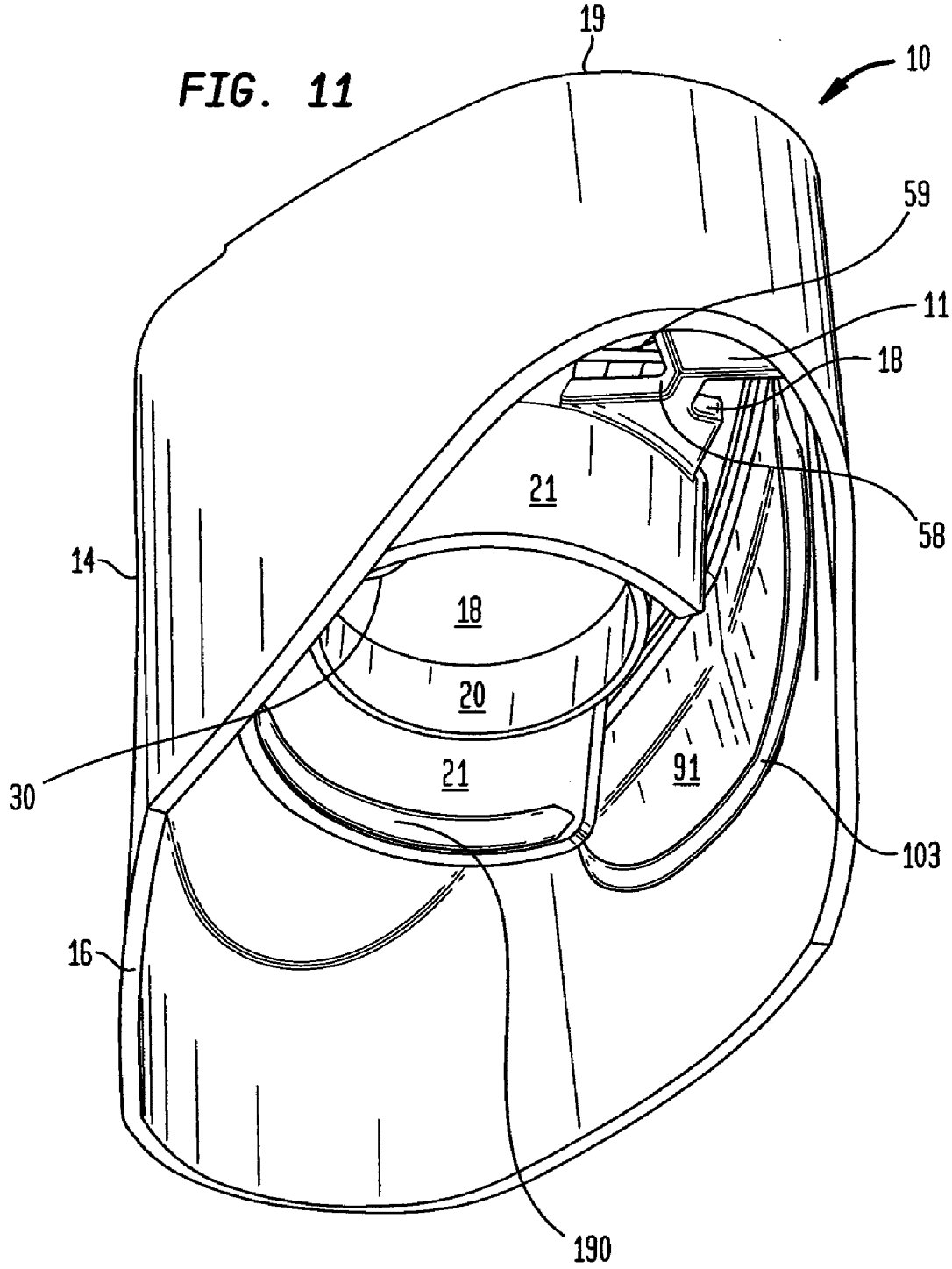
FIG. 11 a bottom perspective view of the closure depicted in FIG. 1

On the other hand, when the top rear wall of the actuator 50 is pushed down to tilt the actuator to the dispensing position as illustrated in FIGS. 2 and 9, then the front portion of the sealing plug 76 is tilted away from the top of the discharge tube 32 to permit flow of the material out of the discharge aperture 30 in tube 32 through conduit 61 and dispensing nozzle 60. When the actuator 50 is tilted to the dispensing position as illustrated in FIGS. 2 and 9, walls 69 (FIGS. 5 and 9) continue to seal the outer periphery of the upper end of the discharge tube 32 so that the container contents, while being dispensed into conduit 61, cannot leak out around the top of the discharge tube 32.

Figure 3:
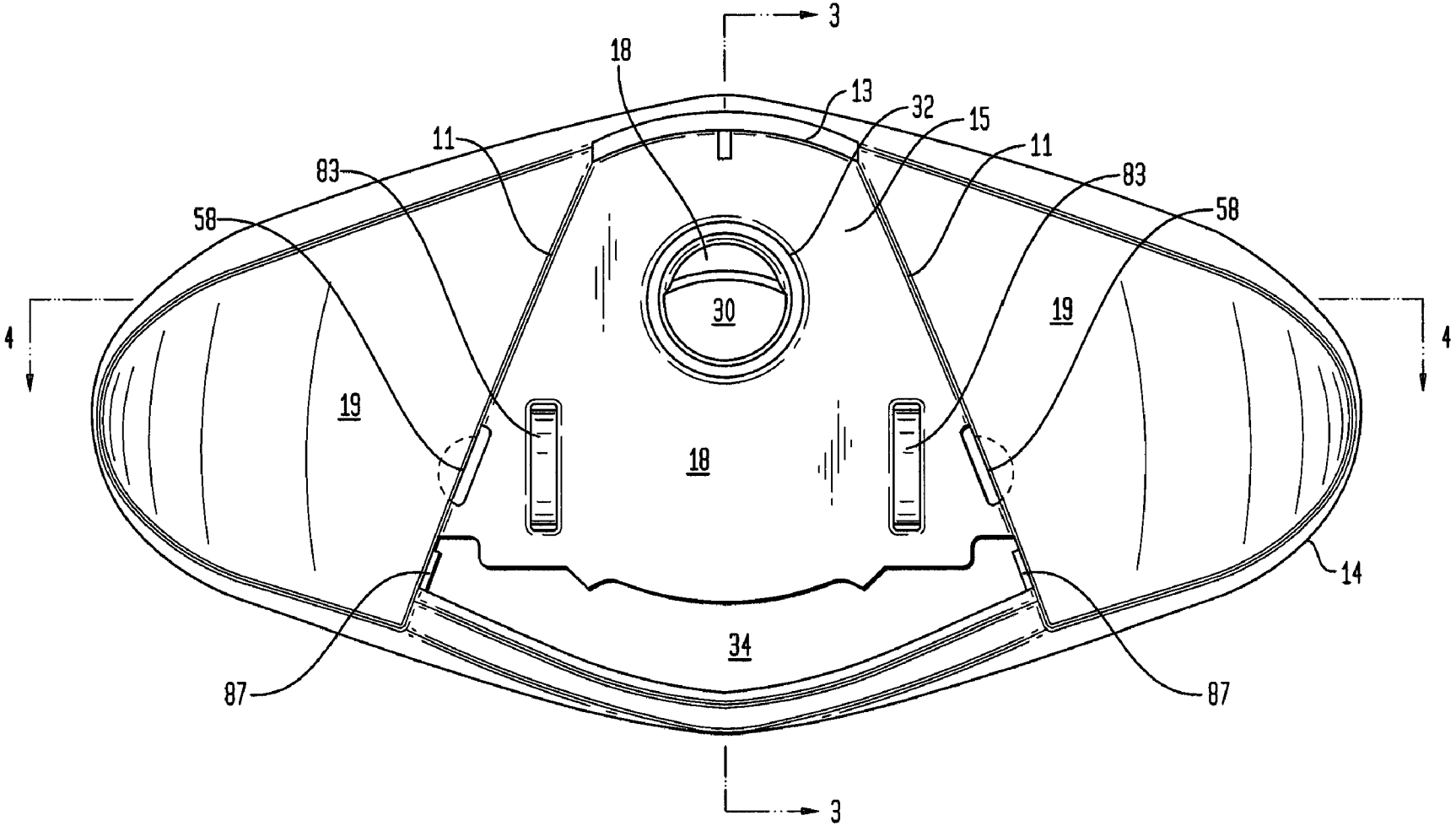
FIG. 3 is a top plan view of the closure with the actuator removed to reveal interior details of the housing.
Figure 4:
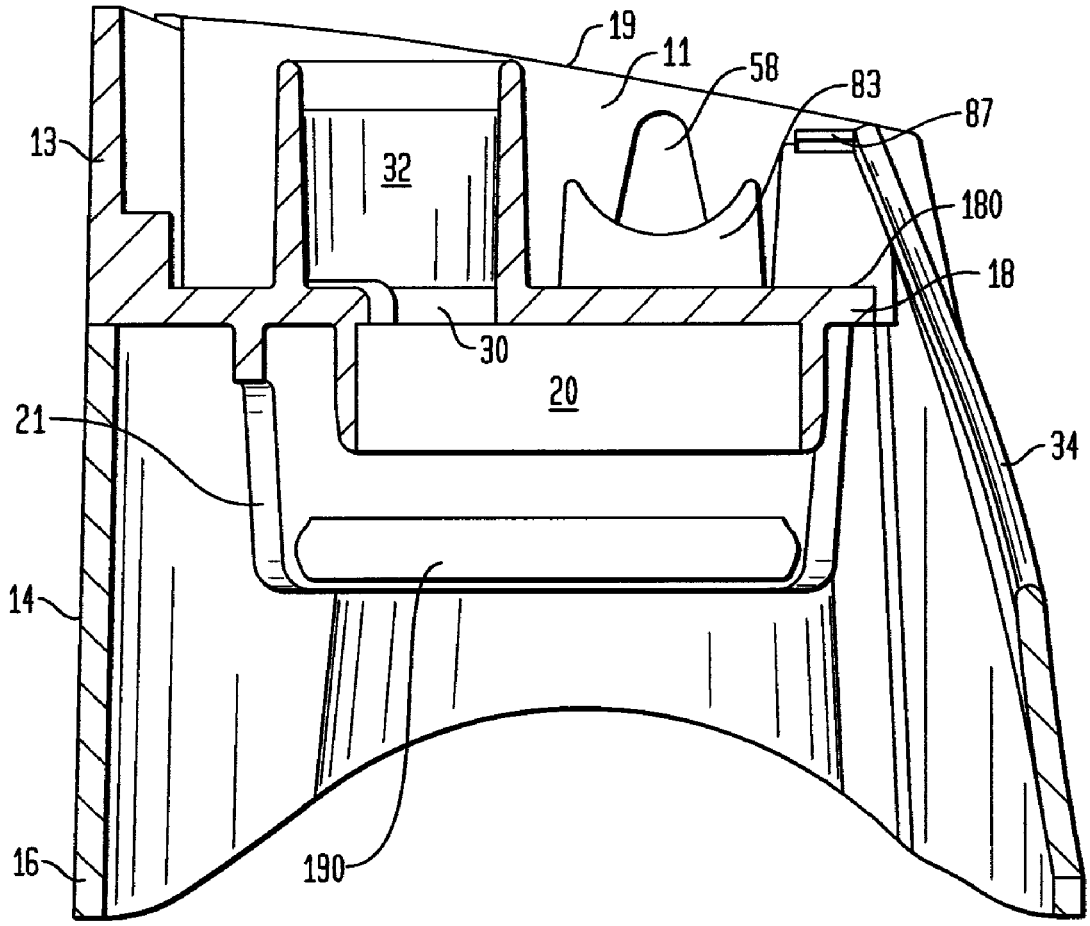
FIG. 4 is a cross-sectional view taken generally along the plane 3-3 in FIG. 3.
Figure 5:
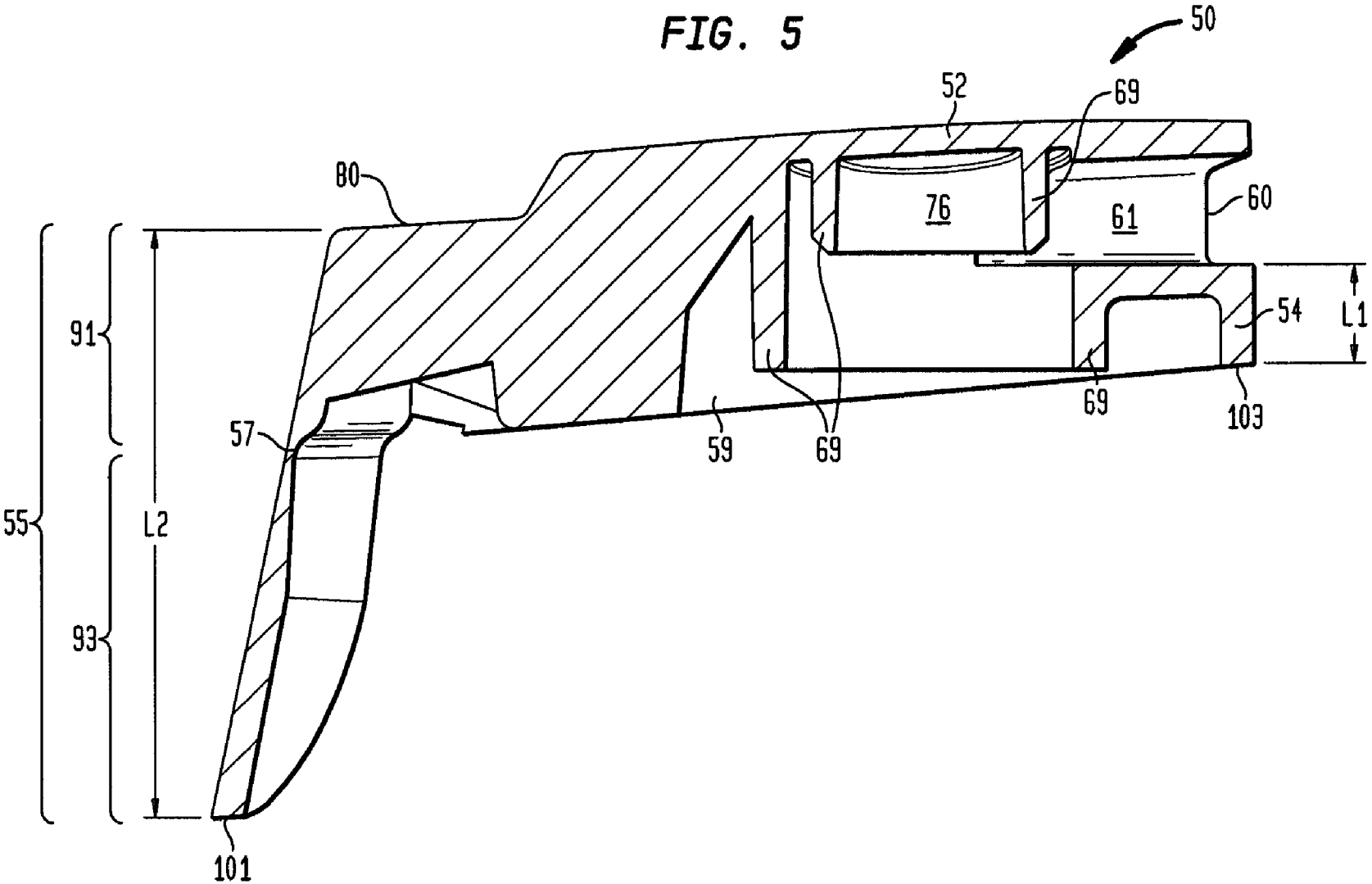
FIG. 5 is an enlarged, cross-sectional view of the actuator taken generally along the plane 1-1 in FIG. 1 with the housing omitted for clarity.

The actuator 50 can be pivoted to the open position by applying a downwardly directed force at the top rear wall 80 of the actuator 50. To this end, the top rear wall 80 is preferably recessed within a well (FIGS. 1, 2, 5 and 7-9) for receiving the end of a thumb or finger. In a preferred embodiment, actuator 50 has axles 81 rigidly connected to the bottom surface of top wall 52 that rotationally engage bearings 83 rigidly mounted on floor 18 (FIGS. 3 and 6). Preferably actuator 50 is further supported by pivot support 85 rigidly connected to the bottom surface of top wall 52 and in pressing engagement with floor 18 while the actuator 50 pivots.

In accordance with the present invention, a deformable integral hinge 57 is provided to prevent both accidental movement of the actuator 50 to the open, dispensing orientation and to allow easy assembly of the actuator into the closure housing 14. This provides a closure which is resistant to inadvertent actuation during shipping and rough handling prior to use by a consumer.

In operation when closure 10 sealingly engages optional container 200, lower rear flange 93 pressingly engages an adjacent portion of container 200 which serves to provide a portion of the resistance to such inadvertent activation until a sufficiently large force is purposely applied to the top rear portion of actuator 50 (FIG. 8). Additional optional forces preventing inadvertent activation of actuator 50 in this preferred embodiment include the sliding resistance shipping posts 87 provide against actuator 50 and the sliding resistance walls 69 provide against discharge tube 32. When a sufficient level of force is applied to the top, rear portion of the actuator 50, the lower rear flange 93 is deflected towards finger recess area 34 (away from the nozzle) (FIG. 9). Simultaneously actuator 50 is pushed below shipping posts 87 and walls 69 are urged over tube 32. The forces to which the actuator may be subjected during shipping and handling are typically insufficient to deflect or deform lower rear flange 93 as well as to overcome the other sources of resistance to tilt the actuator. Thus, the actuator 50 cannot be tilted to any significant extent away from the closed, non-dispensing position.

However, when a consumer subsequently wishes to use the closure, the consumer initially applies a substantially greater force to the top rear wall 80 of actuator 50. A force equal to or greater than, a predetermined force will simultaneously drive actuator 50 passed shipping posts 87, walls 69 passed tube 32 and the lower rear flange 93 against container 200 with a force sufficient to deflect lower rear flange 93 along hinge 57 towards finger access area 34 causing the opening of the actuator 50 (FIG. 9) as described above.

The above-described rear flange retention structure can be readily molded in the closure actuator. Conventional molds can be relatively easily retrofitted to include this feature.

In one aspect of the invention is a toggle-acting dispensing closure 10 for use with an optional container 200, the closure includes but is not limited to:

a. a housing 14 having a transverse floor 18 and outer wall 16;

b. an actuator 50 having a top wall 52 including a top rear wall 80 overlying the transverse floor 18 and defining a nozzle opening 60 with a nozzle floor 105, the actuator 50 being asymmetrically and pivotally mounted inside the housing 14 for movement between a closed, non-dispensing position and an open, dispensing position;

c. a rear actuator flange 55 extending below the top rear wall 80 at a first location within the housing 14;

d. the rear flange 55 having a hinge 57 with a major axis that divides the rear flange 55 into an upper rear flange 91 adjacent to the top rear wall 80 and a lower rear flange 93 adjacent to a rear flange rim 101; and e. whereby the major axis of the hinge is oriented substantially parallel to the transverse floor 18.

Substantially parallel is defined as parallel or nearly so where the orientation of the hinge functions to both prevent inadvertent opening of the closure and facilitate assembly of the actuator into the housing as described above.

Advantageously the closure further includes but is not limited to:

a. a front actuator flange 54 extending below the nozzle floor 105 within the housing 14 having a length L1 normal to the nozzle floor 105 and extending to a front flange rim 103 opposite the nozzle floor;

b. wherein the rear flange 55 has a length L2 normal to the top rear wall 80 and extending to a rear flange rim 101 opposite the top wall 52;

c. wherein the ratio of L1 to L2 is in the range of about 0.1 to 0.33.

L1 preferably has a maximum length of about 6 mm, more preferably in the range of about 1 to 6 mm, most preferably about 3 mm. L2 preferably has a maximum length of about 18 mm, more preferably in the range of about 8 to 18 mm, and most preferably about 15 mm. The ratio of L1 to L2 is preferably about 0.2.

Preferably the hinge 57 is spaced apart from the outer housing wall 16 and has a length L3 wherein the hinge 57 is positioned at a distance of L4 along a line normal to the upper surface 180 of the transverse floor 18 when the hinge is not flexed. Preferably L3 has a minimum length of about 7 mm, more preferably in the range of about 7 to 40 mm, and most preferably about 25 mm. Preferably L4 has a minimum value of 0.1 mm, more preferably L4 is about 1 mm or less, most preferably L4 is less than about 1 mm. The hinge 57 is positioned at a distance of L5 along a line normal to the hinge and extending to the lower rear flange rim when the hinge is not flexed. Preferably the ratio of L4 to L5 is in the range of about 0.01 to 0.20 (advantageously about 0.03). In a preferred embodiment L5 is about 12 mm.

Advantageously the lower rear flange 93 is adapted to resiliently contact an optional container 200 the closure 10 is sealingly engaged to whereby the lower rear flange 93 prevents movement of the actuator 50 on said container 200 in response to the application of a first force at the rear top wall 80 of the actuator opposite the Nozzle ("the first location"), but permits movement of said actuator 50 in response to a substantially higher second force downwardly applied at said first location.

In a preferred embodiment, the hinge is a thin region of plastic of less than or equal to 1 mm in thickness that is integrally molded in the actuator. Preferably the actuator includes but is not limited to a thermoplastic material and the rear lower flange is resilient at 25 C allowing it to flex when a user applies moderate force to the rear of the actuator to open the closure. Preferably this opening force is in the range of about 25 to 50 Newtons (5.6 to 11 lb ft.) and optimally at a minimum of about 30 or 35 Newtons and a maximum of about 40 or 45 Newtons. The actuator thermoplastic flexural modulus range is preferably about 600 to 2000 MPa (mega pascals) at 25 C.

Preferably the axis of rotation of the actuator with respect to the housing is offset from the center line of the housing by at least 80% where 0% allows symmetric rotation and 100% allows no rotation within the housing.

The closure of the present invention can be readily molded from thermoplastic materials and easily assembled to provide a stream-lined product. Thermoplastic resins such as polypropylene and polyethylene are preferably used, since tight engagement must be established between the actuator and the housing and between the housing and the container. Suitable containers that can be employed with the inventive closure are preferably made of such material that enables the vessel to be squeezed by hand and rapidly restored to its original form upon recovery. Examples of suitable materials include thermoplastic resins such as polypropylene, polyethylene, polyethylene terephthalate, polyvinyl chloride, nylon, or laminates thereof, and the like.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

We claim:

1. A toggle-acting dispensing closure for use with a container, the closure comprising:

a. a housing having a transverse floor with an upper surface and outer wall;

b. an actuator having a top wall including a top rear wall overlying the transverse floor and defining a nozzle opening with a nozzle floor, the actuator being asymmetrically and pivotally mounted inside the housing for movement between a closed, non-dispensing position and an open, dispensing position;

c. a rear actuator flange extending below the top rear wall at a first location within the housing;

d. the rear flange having a hinge with a major axis that divides the rear flange into an upper rear flange adjacent to the top rear wall and a lower rear flange adjacent to a rear flange rim; and e. whereby the hinge major axis is oriented substantially parallel to the transverse floor.

2. The closure of claim 1 further comprising:

a. a front actuator flange extending below the nozzle floor within the housing having a length L1 normal to the nozzle floor and extending to a front flange rim opposite the nozzle floor;

b. wherein the rear flange has a length L2 normal to the top rear wall and extending to the rear flange rim opposite the top rear wall;

c. wherein the ratio of L1 to L2 is in the range of about 0.1 to 0.33.

3. The closure of claim 1 wherein the hinge is spaced apart from the outer housing wall, wherein the hinge has a length L3 and is positioned at a distance of L4 along a line normal to the upper surface of the transverse floor when the hinge is not flexed and wherein the hinge is positioned at a distance of L5 along a line normal to the hinge major axis and extending to the lower rear flange rim when the hinge is not flexed and wherein the ratio of L4 to L5 is in the range of about 0.01 to 0.20.

4. The closure of claim 1 wherein the lower rear flange is adapted to resiliently contact a container the closure is sealingly engaged to whereby the lower rear flange prevents movement of the actuator on said container in response to the application of a first force at the first location, but permits movement of said actuator in response to a substantially higher second force downwardly applied at said first location.

5. The closure of claim 1 wherein the hinge is a thin region of plastic of less than or equal to about 1 mm in thickness that is integrally molded in the actuator.

6. The closure of claim 1 in which said actuator comprises a thermoplastic material and the rear lower flange is resilient at 25 C.

7. The closure of claim 1 in which an axis of rotation of the actuator with respect to the housing is offset from a center line of the housing by at least 80% where 0% allows symmetric rotation and 100% allows no rotation of the actuator within the housing.

* * * * *